US007172080B2

(12) United States Patent
Rodriguez

(10) Patent No.: US 7,172,080 B2
(45) Date of Patent: Feb. 6, 2007

(54) ENVELOPE PACKAGE MERCHANDISER

(76) Inventor: Isidoro L. Rodriguez, 7290 Miami Lakeway South, Miami Lakes, FL (US) 33014

( * ) Notice: Subject to any disclaimer, the term of this patent is extended or adjusted under 35 U.S.C. 154(b) by 169 days.

(21) Appl. No.: 10/622,418

(22) Filed: Jul. 18, 2003

(65) Prior Publication Data

US 2005/0023235 A1 Feb. 3, 2005

(51) Int. Cl.
*A47F 7/02* (2006.01)

(52) U.S. Cl. ..... 211/85.15

(58) Field of Classification Search ..... 211/85.15, 211/10, 12, 113, 50, 78, 163; 40/124
See application file for complete search history.

(56) References Cited

U.S. PATENT DOCUMENTS 1,741,068 A * 12/1929 Newsom ..... 239/60
3,789,526 A * 2/1974 Lavinson ..... 40/124
4,787,522 A * 11/1988 Nocek et al. ..... 211/85.15
4,852,280 A * 8/1989 Beattie ..... 40/124
5,335,796 A * 8/1994 Sanford et al. ..... 211/45
5,385,245 A * 1/1995 Waters ..... 211/85.3
5,467,949 A * 11/1995 Lemke ..... 248/95
6,283,312 B1 * 9/2001 Edgerton ..... 211/113

* cited by examiner

*Primary Examiner*—Sarah Purol

(57) ABSTRACT

Disclosed is a merchandiser for envelope packaging comprising one or more pair of pinch barriers defining a pinch gap, said gap of a width effective in pinching a pinchable portion of one or more envelope packages proximate to a relatively rigid portion of said envelope packages, and wherein said pinching is to a degree effective in securing said envelope packages within said pinch gap while permitting easy pull removal of said envelope package without damage thereto.

8 Claims, 7 Drawing Sheets

ENVELOPE PACKAGE MERCHANDISER

BACKGROUND OF THE DISCLOSURE

1. Field of the Disclosure

This disclosure relates to devices for displaying and dispensing envelope package goods.

2. Description of Related Art

Envelope packaging for various products, most notably snack foods is well known in the art. This type of packaging has variously also been referred to as "snack packaging" and "single-serve packaging" and typically appear as shown in FIGS. 2*a* and 2*b*.

A number of devices for displaying and dispensing envelope packages—so-called "merchandisers"—are well known in the art, such as that described in the inventor's previous patent in this field, U.S. Pat. No. 4,817,805, issued Apr. 4, 1989, for an APPARATUS FOR SECURELY DISPLAYING AND DISPENSING OF ENVELOPE PACKAGE GOODS, wherein there was disclosed a strip with adhesive areas to which the individual snack bags were adhered. Consumers simply pull a bag off the adhesive area for purchase. This system has the advantage of being able to be preloaded by machine such that the snack distributor merely removes the old strip and hangs a new one already preloaded with snacks. The old strip is taken back and reloaded The drawback of this system is that it is costly to produce because an adhesive must be positioned and applied to the strip. Also, the adhesive becomes weak over time due to airborne dust contamination, eventually rendering the device useless.

Also known are racks with clips for clipping the packages. These are also expensive to produce and troublesome to load. This is particularly troublesome and time-consuming when the rack remains in the store and must be reloaded periodically by manually clipping snack bags into the clips. Another problem arises when attempting to clip more than one bag into a single clip, namely that when the consumer pulls a bag out the other bags fall out.

Most of the merchandiser schemes in the art are complex and costly due to the need for an intermediary attachment device to attach the envelope packages to a support structure. The intermediary may be a metal clip or adhesive as described above, or bits of adhesive tape as described in Belt, U.S. Pat. No. 6,405,778 B1, for an APPARATUS FOR PRODUCING A PRELOADED MERCHANDISER, issued Jun. 18, 2002. The Belt system has the advantage of preloading, but requires the consumption of bits of tape, which are not reusable. Intermediary attachment devices necessarily consume resources and time, as it is necessary to assemble the attachment device to both the support structure and to the bag, thus requiring two attachment steps.

What is needed is a preloadable apparatus for merchandising envelope package goods that does not require the use of any nonreuseable components. What is needed is a merchandizing apparatus that lacks any intermediary attachment device, such that the loading of the apparatus is performed swiftly and efficiently, whether preloaded or not.

SUMMARY OF THE DISCLOSURE

Disclosed is a merchandiser for envelope packaging comprising one or more pair of pinch barriers defining a pinch gap, said gap of a width effective in pinching a pinchable portion of one or more envelope packages proximate to a relatively rigid portion of said envelope packages, and wherein said pinching is to a degree effective in securing said envelope packages within said pinch gap while permitting easy pull removal of said envelope package without damage thereto.

In another aspect of the apparatus, said pair of pinch barriers comprises a pair of rods.

In another aspect of the apparatus, said pinch barriers are arranged in a rack.

In another aspect of the apparatus, said pinch barriers are arranged in a carousel.

In another aspect of the apparatus, said carousel is adapted to rotate.

In another aspect of the apparatus, said pinch barriers comprise the sidewalls of an aperture defined in a sheet of material.

In another aspect of the apparatus, said sheet of material is flexible.

Disclosed is a preloaded merchandiser for envelope packaging, comprising one or more pair of pinch barriers defining a pinch gap, said gap of a width effective in pinching a pinchable portion of one or more envelope packages proximate to a relatively rigid portion of said envelope packages, wherein said pinching is to a degree effective in securing said envelope packages within said pinch gap while permitting easy pull removal of said envelope package without damage thereto, and wherein one or more envelope packages are so secured thereon.

DETAILED DESCRIPTION OF THE PREFERRED EMBODIMENTS

Figure 1:
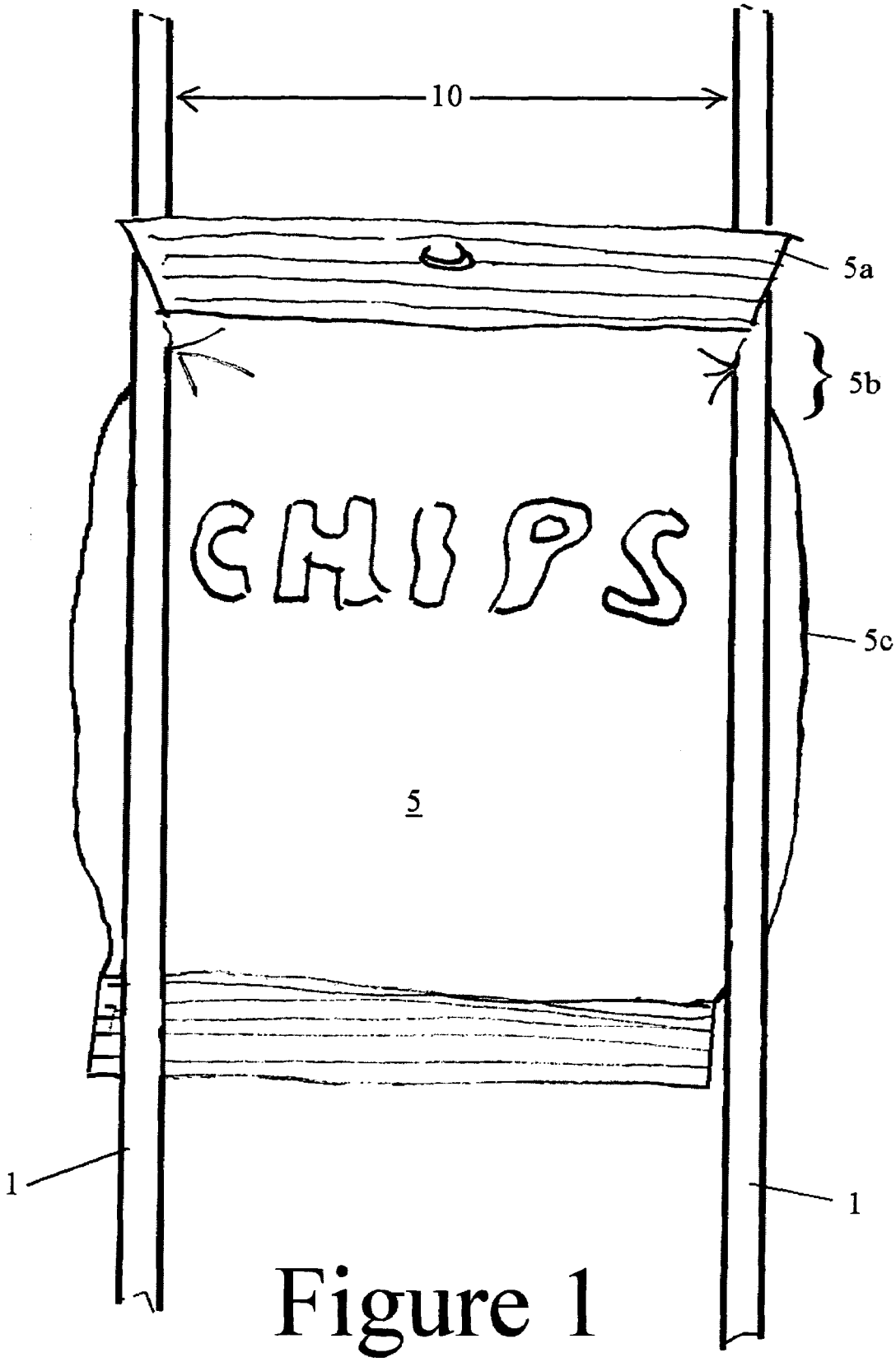
FIG. 1 shows the basic functioning of the invention.
Figure 2A:
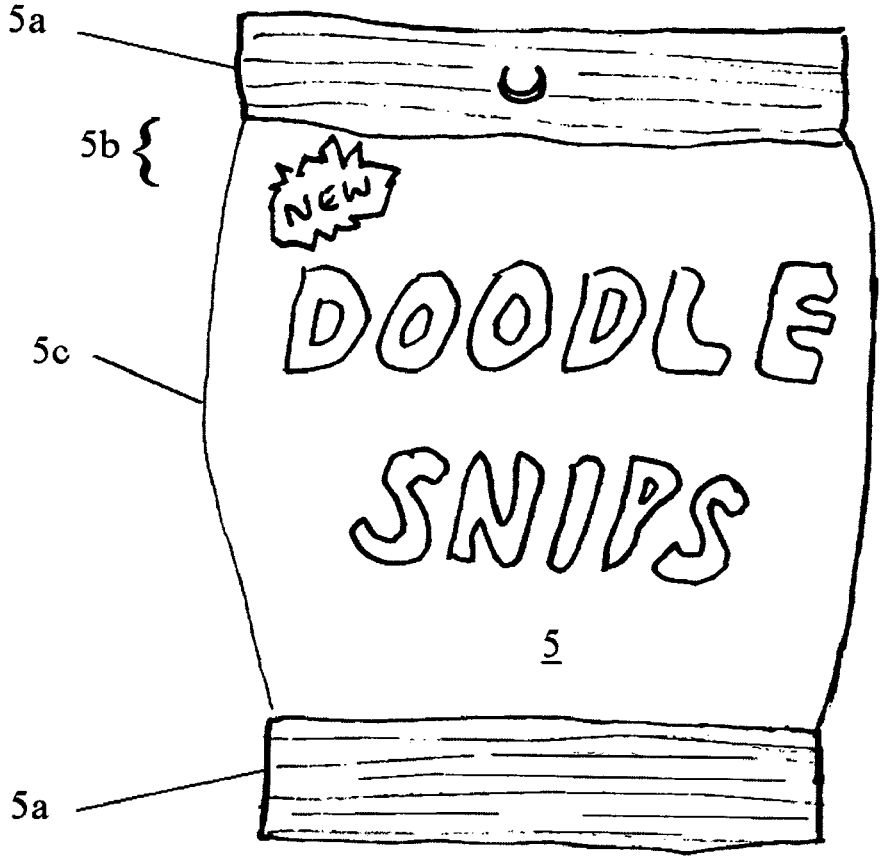
FIGS. 2*a* and 2*b* show a typical envelope package.
Figure 2B:
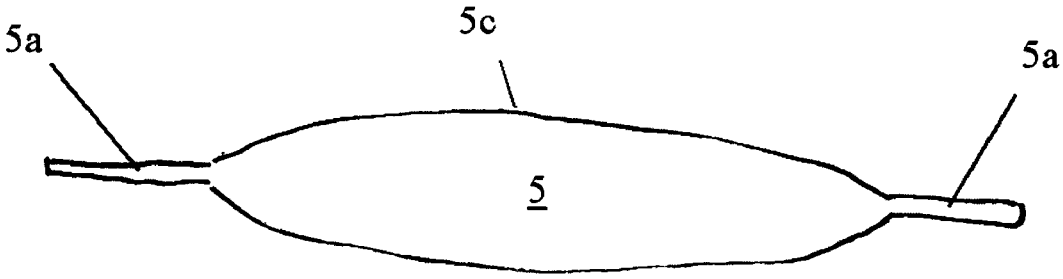

Referring to FIGS. 1 and 2, there is shown a basic embodiment of the apparatus of the disclosure wherein there is provided a pair of pinch barriers 1 that define a pinch gap 10 of a width effective in pinching a pinchable portion 5*b* of an envelope package 5. The degree of pinch is chosen to be sufficient to secure the package while allowing the package to be pulled out of the gap without damage to the package. The pinch barriers typically will be metal or plastic rods of ⅛ to ⅜ inch in width or diameter.

For the purposes of this disclosure, "envelope package" means a packaging that has a relatively squeezable body portion 5*c* and a relatively rigid portion 5*a* that thereby defines a pinchable portion 5*b*. Typically, such bags are used in the snack food industry for the packaging of chips, candies, pork rinds, and the like. The rigid portion or portions 5*a* are heat seals, while the squeezable portion 5*c* is the body of the bag holding the consumables. Because the heat seal 5*a* is relatively rigid in comparison to the body 5*c* of the bag, it is possible to "bottleneck" the bag by pinching it just behind the seal as is shown in FIG. 1.

Also helpful is the fact that these envelope package snack bags 5 are almost always hermetically sealed. Hence, the pinching action is enhanced because when the pinchable portion 5*c* is pinched, the body 5*c* of the bag tends to inflate and puff up, thereby enhancing the bottleneck effect.

Typically, an envelope package 5 will vary widely in width, but will generally be about 5 inches. For such a bag, a pinch gap of from 3 to 4.5 will be useful, preferably from 3.5 to 4 inches. As a general rule of thumb, the pinch gap should be about 75% to about 85% the width of the rigid portion 5*a* of the envelope bag.

Figure 3:
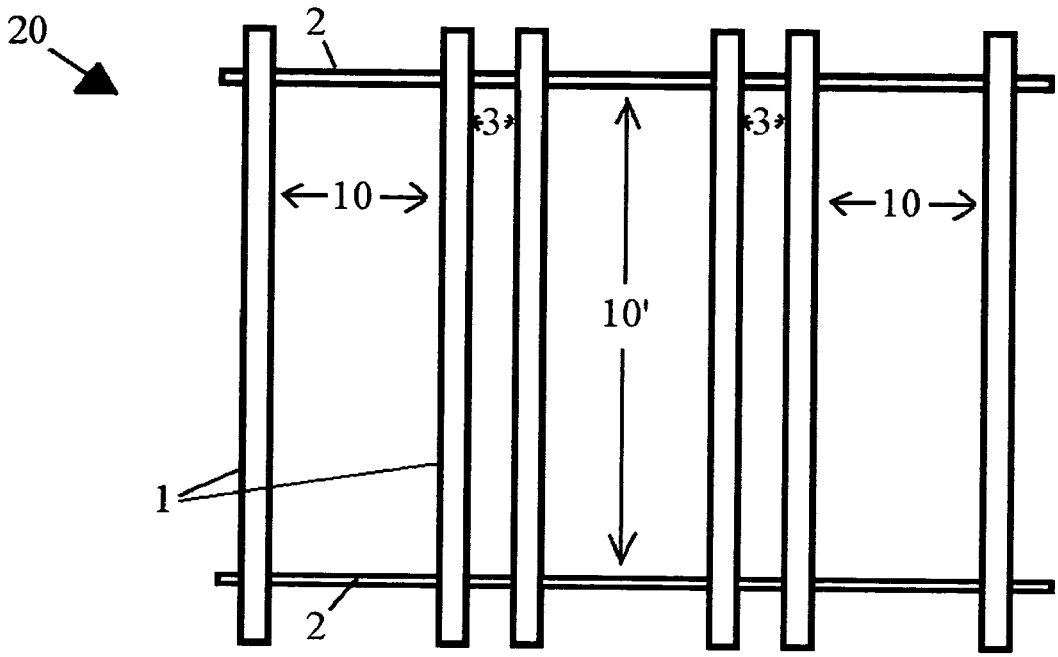
FIG. 3 shows a rack embodiment of the disclosure.

Referring to FIG. 3, there is shown a rack merchandiser 20 embodiment of the invention wherein a rack 20 is formed by supplying cross-supports 2 to support the pinch barriers 1. Each pair of pinch barriers may be elongate as shown and thereby define a pinch column 10' that may hold many envelope packages stacked one upon the other. It is preferred that relatively small spaces 3 be provided between pinch columns 10' to allow room for adjacent rigid portions of bags stacked into the pinch gaps 10. Such a device may be preloaded and delivered to the sale point (i.e., the store) or may be permanently mounted at the sale point and reloaded as needed. Because there is no intermediate attachment device, the user need simply push the sealed ends of snack bags into the pinch gap 10 to quickly load a stack of bags in each pinch column 10'.

Figure 4:
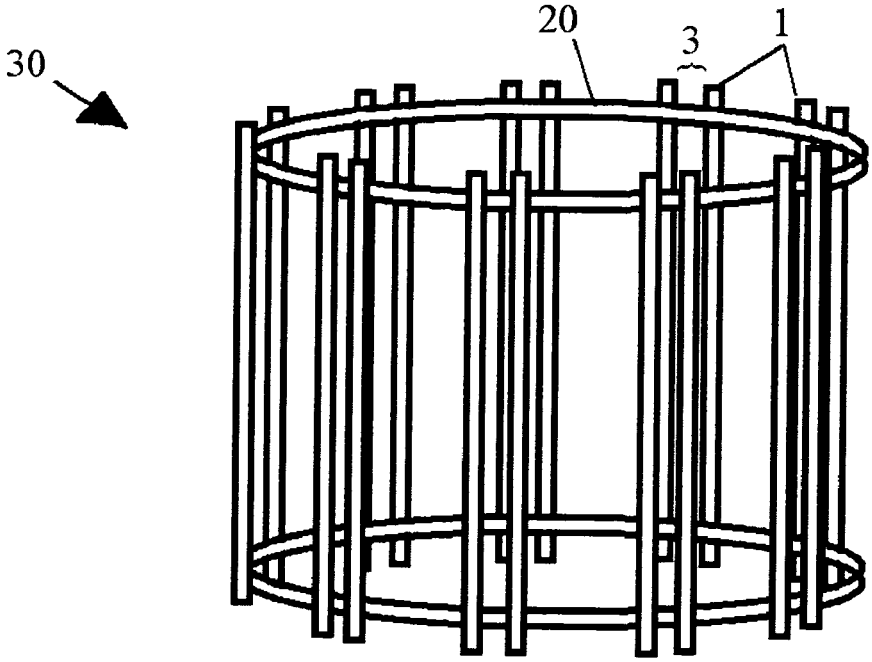
FIG. 4 shows a carousel embodiment of the disclosure.

Referring to FIG. 4, there is shown a carousel merchandiser 30 embodiment of the disclosure wherein the pinch barriers 1 are affixed to one or more circular supports 20. The carousel may be rotatably mounted on a shaft to allow purchasers to rotate through the products on display. A hub and shaft for such a rotatable mounting are not shown so as to avoid cluttering the drawing, but of course such a mounting is well known in the mechanical art.

Figure 5:
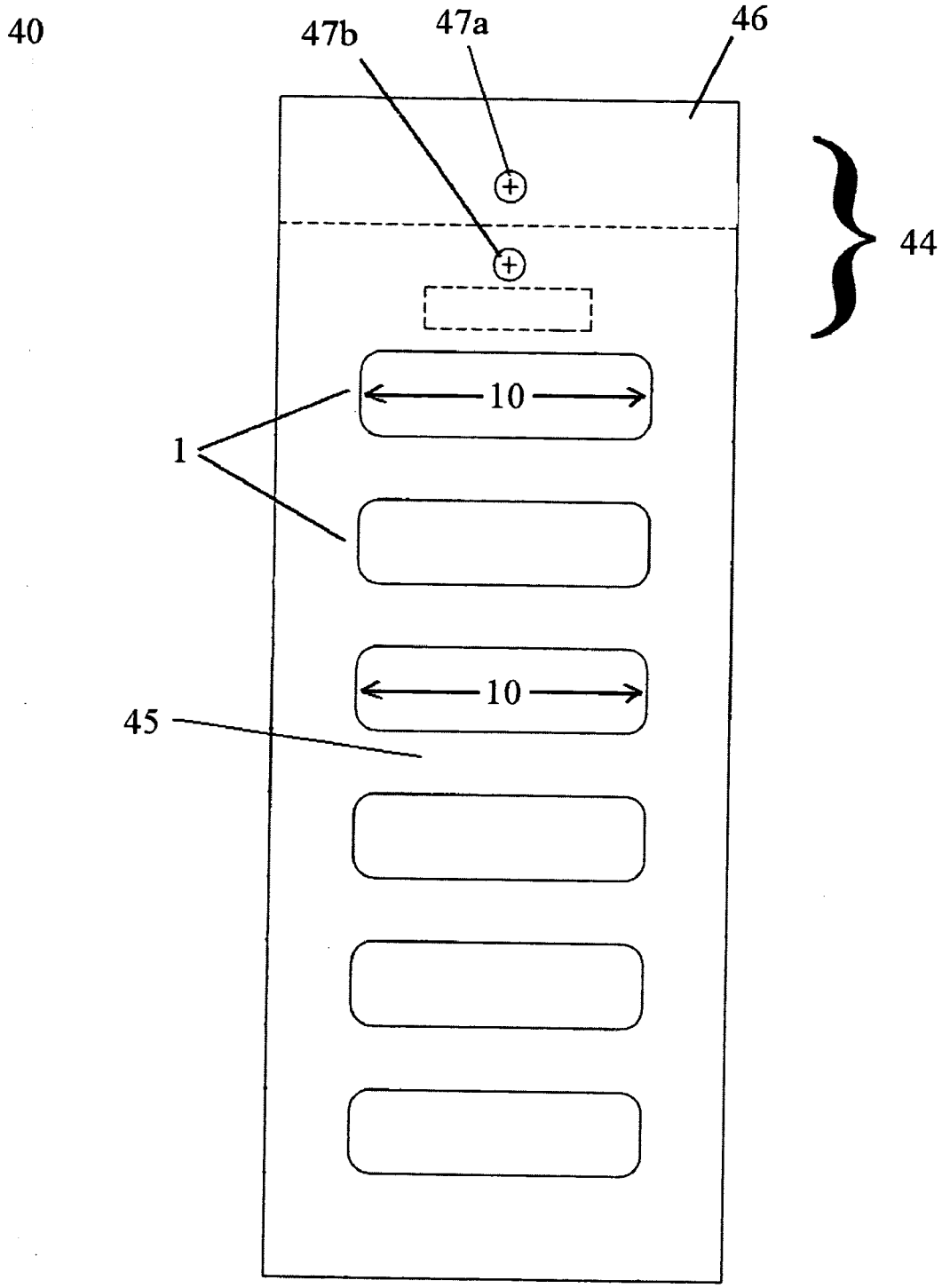
FIG. 5 show a strip embodiment of the disclosure.

FIG. 5 shows a strip merchandiser 40 embodiment of the disclosure wherein the pinch barriers 1 are defined by providing pinch gaps 10. The pinch gaps are provided by punching out or otherwise forming apertures in a strip of material 45. The material will preferably be cheap and durable, such as plastic or cardboard and will be from about 1/16 to 3/8 inch thick.

It may also be preferable that the strip 40 be flexible. A flexible strip is necessarily thin (e.g., 1/16 to 3/16 inch thick plastic) and therefore cheaper, but also has the advantage of being more easily manipulated by any machine designed to preload the strip 40.

Figure 6A:
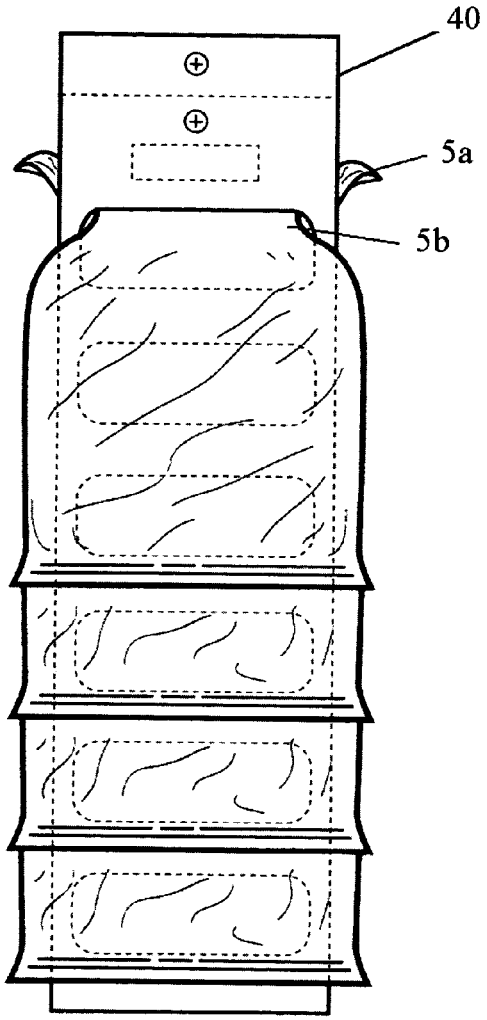
FIGS. 6*a* and 6*b* shows the strip embodiment of FIG. 5 loaded with envelope packages.
Figure 6B:
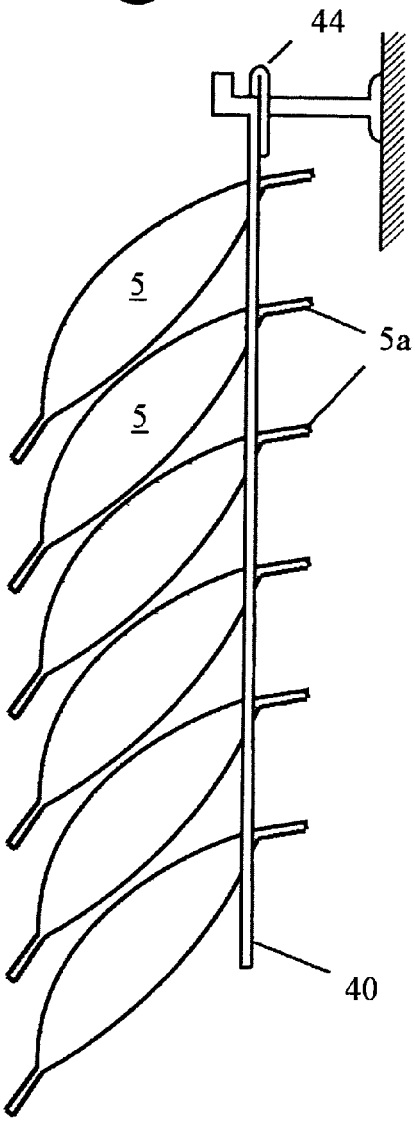
Figure 6C:
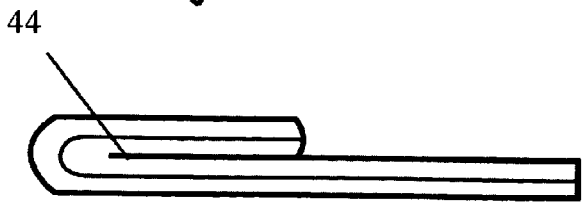
FIG. 6*c* shows an embodiment of the hanging portion of the strip embodiment.

A hanger 44 may also be provided such that the strip is easily hung upon a hook or the like. Because the strip will preferably be of a relatively thin material, a reinforced hanger 44 is easily provided by providing two hanging holes 47*a*, 47*b*. A first hanging hole 47*a* is defined on a hanging flap 44 that folds over such that the first hanging hole 47*a* is aligned with a second hanging hole 47*b*. Hence, the strip material 45 in the hanging area is thereby doubled in thickness and strength as can be seen in FIGS. 6*b* and 6*c*.

Figure 7:
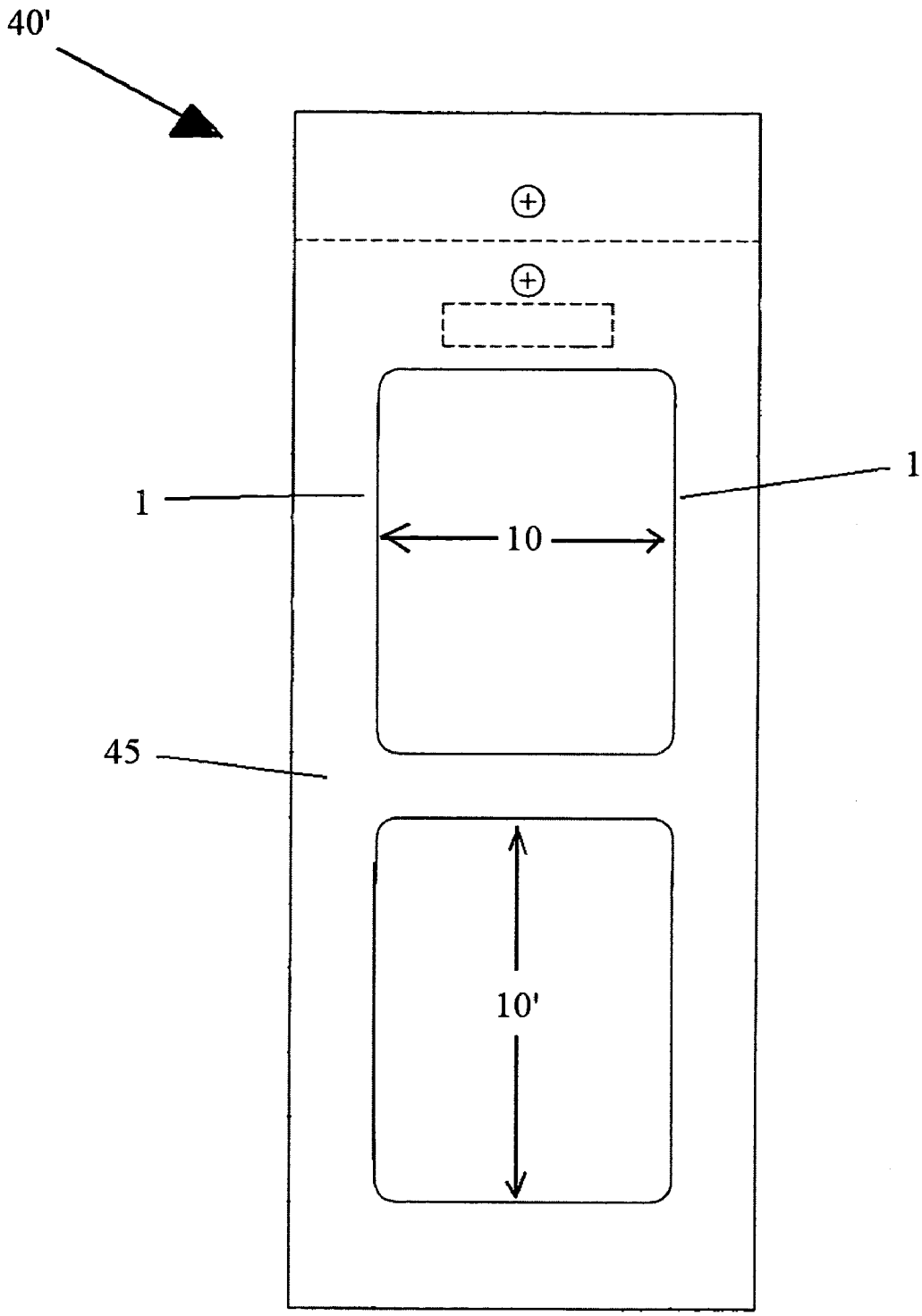
FIG. 7 shows another embodiment of a strip embodiment of the disclosure.
Figure 8:
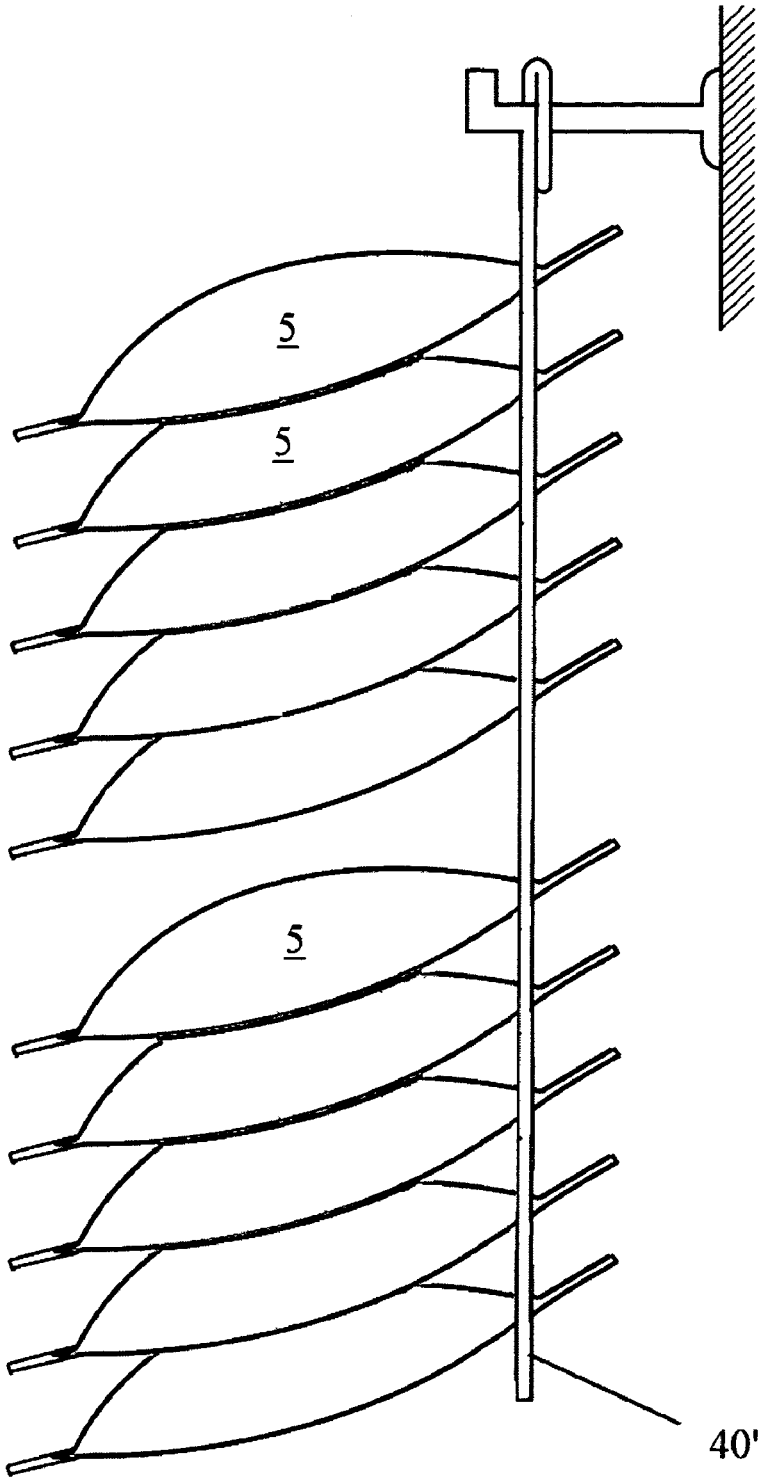
FIG. 8 shows the strip embodiment of FIG. 7 loaded with envelope packages.

Referring to FIGS. 7 and 8, there is shown a columnar strip merchandiser 40' embodiment of the disclosure wherein the pinch gaps 10 are elongate so as to provide pinch columns 10' capable of holding a plurality of envelope packages 5.

One of the surprising aspects of the pinch column embodiments of the invention is the fact that the consumer can pull any bag out of a column stack—whether it be the top bag, the bottom bag, or a bag in the middle—and the remaining bags stay pinched in the apparatus. Pulling the bottom bag out, for example, merely results in the upper bags sliding down the pinch column.

As can be seen, by eliminating intermediary attachment devices, it is now possible to rapidly load a merchandiser for envelope packages, such as are used in the snack food industry. Further, the device of the invention is easily and cheaply manufactured and easily preloaded for distribution to the sale point. Still further, the simple loading nature makes the device of the disclosure suited to automated preloading.

While various values, scalar and otherwise, may be disclosed herein, it is to be understood that these are not exact values, but rather to be interpreted as "about" such values, unless explicitly stated otherwise. Further, the use of a modifier such as "about" or "approximately" in this specification with respect to any value is not to imply that the absence of such a modifier with respect to another value indicated the latter to be exact.

Changes and modifications can be made by those skilled in the art to the embodiments as disclosed herein and such examples, illustrations, and theories are for explanatory purposes and are not intended to limit the scope of the claims. Further, the abstract of this disclosure is provided for the sole purpose of complying with the rules requiring an abstract so as to allow a searcher or other reader to quickly ascertain the subject matter of the disclosures contained herein and is submitted with the express understanding that it will not be used to interpret or to limit the scope or the meaning of the claims.

What is claimed is:

1. A merchandiser for envelope packaging, comprising:

one or more pair of pinch barriers defining a pinch gap, said gap of a width effective in pinching a pinchable portion of one or more envelope packages proximate to a relatively rigid portion of said envelope packages; and wherein said pinching is to a degree effective in securing said envelope packages within said pinch gap while permitting easy pull removal of said envelope package without damage thereto, said pinch gap having a width of about 3 to about 4.5 inches.

2. The apparatus of claim 1 wherein each said pair of pinch barriers comprises a pair of rods.

3. The apparatus of claim 1 wherein said pinch barriers are arranged in a rack.

4. The apparatus of claim 1 wherein said pinch barriers are arranged in a carousel.

5. The apparatus of claim 4 wherein said carousel is adapted to rotate.

6. The apparatus of claim 1 wherein said pinch barriers comprise the sidewalls of an aperture defined in a sheet of material.

7. The apparatus of claim 6 wherein said sheet of material is flexible.

8. A preloaded merchandiser for envelope packaging, comprising:

one or more pair of pinch barriers defining a pinch gap, said gap of a width effective in pinching a pinchable portion of one or more envelope packages proximate to a relatively rigid portion of said envelope packages;

wherein said pinching is to a degree effective in securing said envelope packages within said pinch gap while permitting easy pull removal of said envelope package without damage thereto;

wherein one or more envelope packages are so secured thereon; and wherein the gap width is from about 75% to about 85% the width of said relatively rigid portion of said one or more envelope packages.

* * * * *